US006994564B1

(12) United States Patent
Kan

(10) Patent No.: US 6,994,564 B1
(45) Date of Patent: Feb. 7, 2006

(54) CONNECTOR HAVING DUAL FUNCTIONS

(76) Inventor: Shin-Nan Kan, No. 209, Sec. 2, Chung Cheng Road, Hu Ko, Hsinchu Hsien (TW)

( * ) Notice: Subject to any disclaimer, the term of this patent is extended or adjusted under 35 U.S.C. 154(b) by 0 days.

(21) Appl. No.: 10/962,525

(22) Filed: Oct. 13, 2004

(51) Int. Cl.
*H01R 12/20* (2006.01)

(52) U.S. Cl. ..... 439/63; 439/80

(58) Field of Classification Search ..... 439/63, 439/80, 580, 578, 579, 581–585, 108; 29/873
See application file for complete search history.

(56) References Cited

U.S. PATENT DOCUMENTS 4,674,809 A * 6/1987 Hollyday et al. ..... 439/92
4,702,707 A * 10/1987 Hillbish ..... 439/80
4,741,703 A * 5/1988 Johnescu et al. ..... 439/63
5,046,952 A * 9/1991 Cohen et al. ..... 439/63
6,164,977 A * 12/2000 Lester ..... 439/63
6,227,904 B1 * 5/2001 Wang et al. ..... 439/541.5
6,386,888 B1 * 5/2002 Skopic et al. ..... 439/63
6,623,277 B1 * 9/2003 Zhu et al. ..... 439/63
6,688,908 B2 * 2/2004 Wallace ..... 439/490
6,695,644 B2 * 2/2004 Zhao et al. ..... 439/580
6,821,150 B2 * 11/2004 Hall et al. ..... 439/608
6,932,614 B1 * 8/2005 Kan ..... 439/580

* cited by examiner

*Primary Examiner*—Alexander Gilman
(74) *Attorney, Agent, or Firm*—Rosenberg, Klein & Lee

(57) ABSTRACT

A connector has a small volume for facilitating utilizations in electronic apparatus. The connector includes a T-shape body, which connects with a positive-pole connecting leg and a negative-pole sleeve therein, wherein the leg and the sleeve have their tail ends to be folded. When a connecting pin inserts into the body, the power source and signal source can be securely connected at the same time for perfect conduction with dual functions.

1 Claim, 3 Drawing Sheets

CONNECTOR HAVING DUAL FUNCTIONS

FIELD OF THE INVENTION

The present invention relates to a connector, which has two functions for connecting with a power source and a signal source at the same time. And the connector has a small volume for facilitating use in many electronic machines.

BACKGROUND OF THE INVENTION

In most electronic apparatus, a socket for connecting with a power source is necessary. If a signal source is to be provided, a separated socket must be mounted in the apparatus then. Hence, the volume of the apparatus will be increased that would be lack of utilization for these days requirements. There are some improvements to provide a single connector for dual functions but the known improvements still occupy large volume.

SUMMARY OF THE INVENTION

The present invention is to provide a new connector, which has dual functions for connecting with the power source and the signal source at the same time and has a small volume that overcomes drawbacks of all prior ones. Now, accompanying with the following drawings, the character of the present invention will be described here and after.

DETAILED DESCRIPTION OF THE PREFERRED EMBODIMENT

Figure 1:
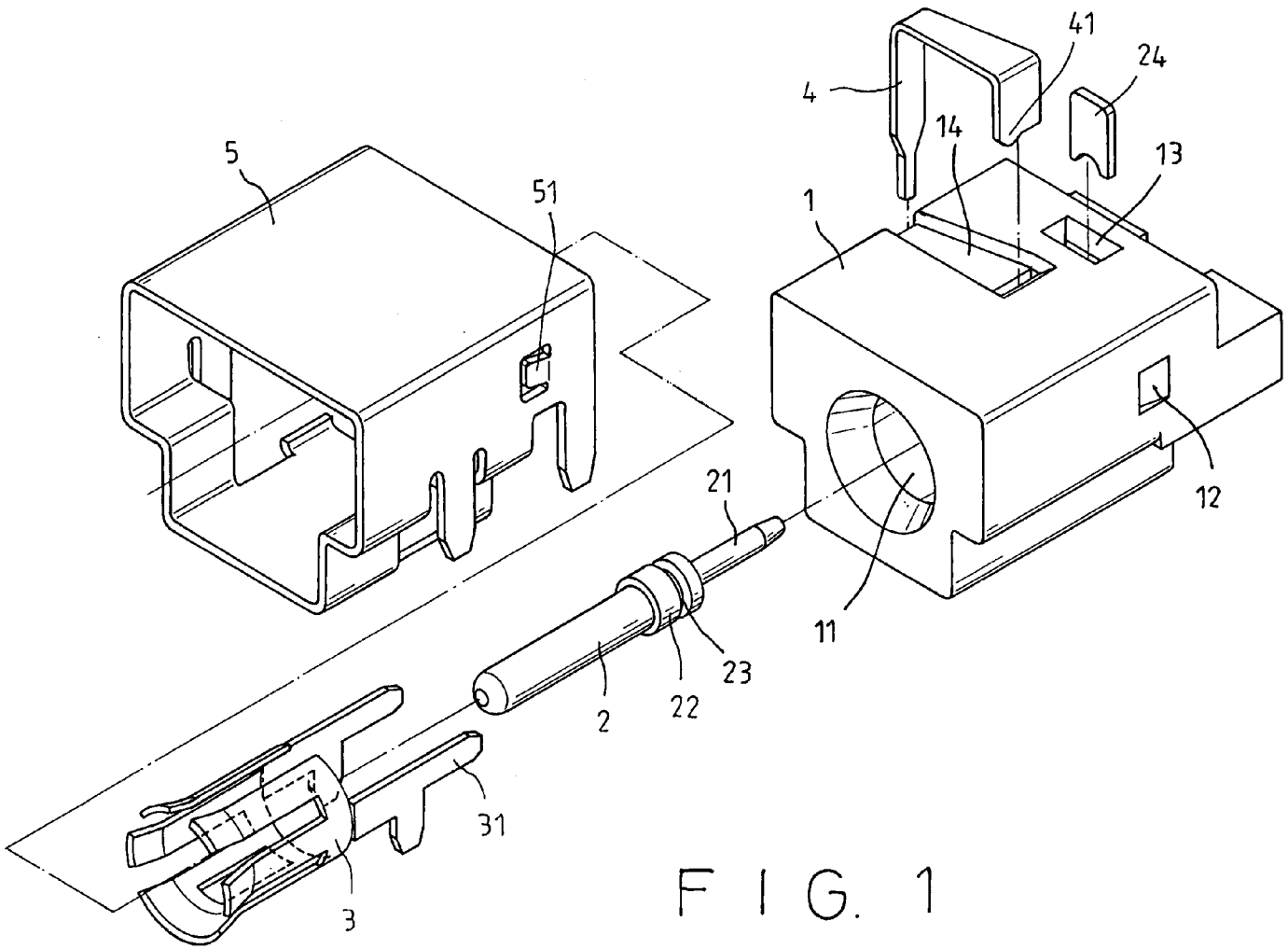
FIG. 1 is an exploded perspective view showing a connector according to the present invention.
Figure 2:
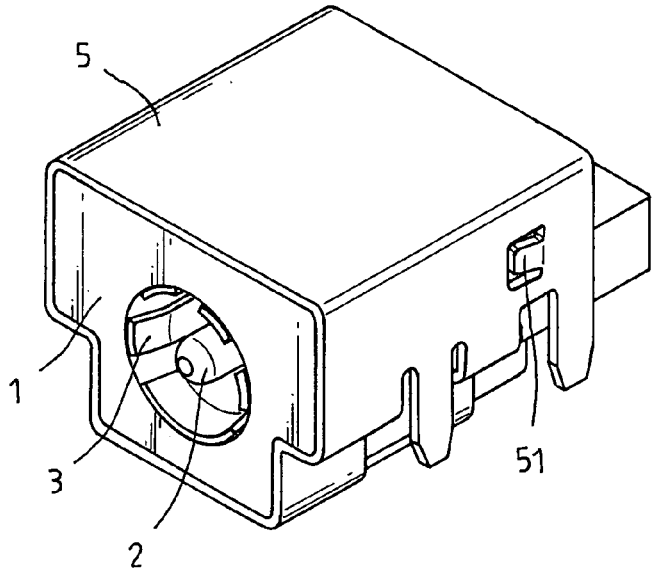
FIG. 2 is an assembled perspective view of FIG. 1.
Figure 3:
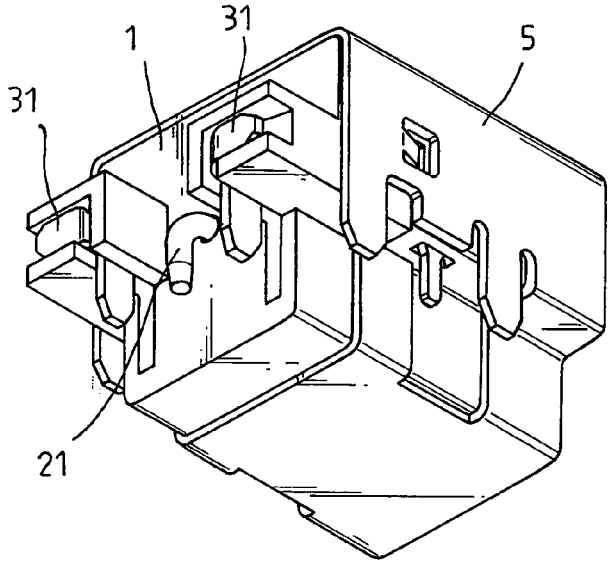
FIG. 3 is another perspective view showing the connector of FIG. 2.

Please referring to FIGS. 1 to 3, the present invention relates to a connector, which includes a hollow T-shape body (1) with a front opening (11) and side grooves (12). A hole (13) and a recess (14) are formed on top surface of the body

(1). A positive-pole connecting leg (2) is received in the opening (11). The tail end (21) passing through the body (1) is folded. The leg (2) is provided with a middle ring (22) with an annular groove (23), which is capable of allowing a slice (24) to be inserted into the hole (13) and engaged within the groove (23) for positioning the leg (2) in the body (1) firmly. A negative-pole metal sleeve (3) is received in the opening (11) around the leg (2). The metal sleeve (3) has two conductive ends (31), which pass through the body (1) and can be folded to obtain a secure connection with the body (1). A signal plug (4) is engaged with the recess (14) while its inner end (41) can insert into the body (1) and reaches in the opening (11). A shell (5) is provided to cover body (1) and all above means, wherein the shell (5) has side engaging pieces (51) for connecting with the side grooves (12) of the body (1) to obtain a firm connection and become a single object.

Figure 4:
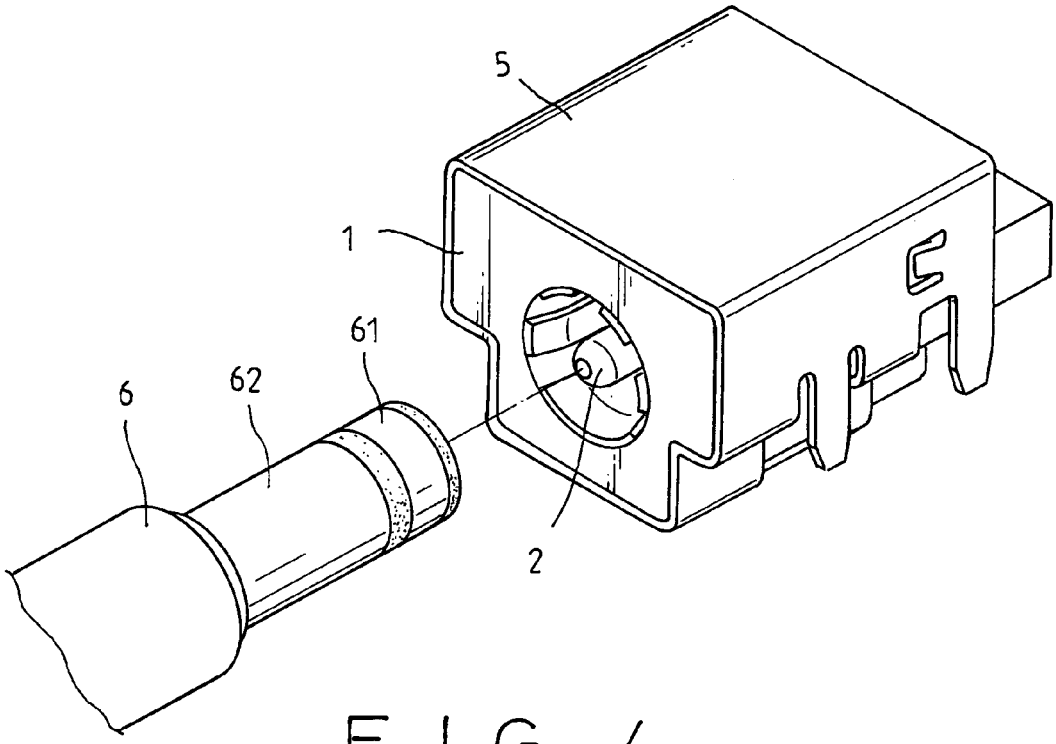
FIG. 4 is a perspective view showing the connector accompanying with a connecting pin according to the present invention.
Figure 5:
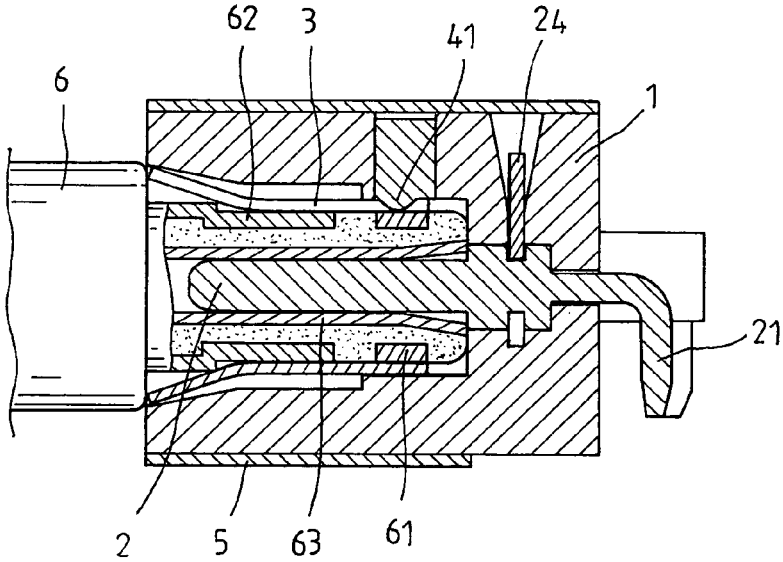
FIG. 5 is an assembled cross-sectional plan view of FIG. 4.

In use, the connector according to the present invention has a small volume that facilitates utilization for any electronic apparatus. As shown in FIGS. 4 and 5, when a connecting pin (6) inserts into the opening (11), its outer metal portion (61) can connect with the inner end (41) of the signal plug (4) and its middle metal portion (62) contacts with the around metal sleeve (3), while its inner metal portion (63) contacts with the positive-pole leg (2). The connection would be so perfect that reaches the purposes of connecting with the power source and the signal source at the same time with a small volume of the connector.

I claim:

1. A connector having dual functions including a hollow T-shape body with a front opening and side grooves, a hole and a recess being formed on top surface of the body; a positive-pole connecting leg being received in the opening, the tail end of which passing through the body and being folded, and the leg being provided with a middle ring with an annular groove, which is capable of allowing a slice to be inserted into the hole and engaged within the groove for positioning the leg in the body firmly; a negative-pole metal sleeve being received in the opening around the leg, having two conductive ends, which pass through the body and can be folded to obtain a secure connection with the body; and a signal plug being engaged with the recess while its inner end can insert into the body and reaches in the opening, and a shell being provided to cover body and all above means, wherein the shell having side engaging pieces for connecting with the side grooves of the body to obtain a firm connection and become a single object.

* * * * *